US005927127A

United States Patent [19]

Klamma et al.

[11] Patent Number: 5,927,127

[45] Date of Patent: Jul. 27, 1999

[54] REVERSING COMPACT INSTALLATION FOR COLD ROLLING STRIP-SHAPED ROLLING MATERIAL

[75] Inventors: Klaus Klamma; Wilfried Bald, both of Hilchenbach, Germany

[73] Assignee: SMS Schloemann-Siemag Aktiengesellschaft, Dusseldorf, Germany

[21] Appl. No.: 08/993,840

[22] Filed: Dec. 18, 1997

Related U.S. Application Data

[63] Continuation of application No. 08/762,904, Dec. 10, 1996, Pat. No. 5,746,081, which is a continuation-in-part of application No. 08/217,579, Mar. 25, 1994, abandoned.

[30] Foreign Application Priority Data

Mar. 27, 1993 [DE] Germany ..... 9 43 10 063

[51] Int. Cl.[6] ..... B21B 41/06

[52] U.S. Cl. ..... 72/229

[58] Field of Search ..... 72/205, 227, 228, 72/229, 230, 239, 238

[56] References Cited

U.S. PATENT DOCUMENTS

| | | | |
|---|---|---|---|
| 3,747,387 | 7/1973 | Shumaker | 72/239 |
| 5,140,837 | 8/1992 | Thomas et al. | 72/229 |
| 5,746,081 | 5/1998 | Klamma et al. | 72/229 |

FOREIGN PATENT DOCUMENTS

| | | | |
|---|---|---|---|
| 62-151209 | 7/1987 | Japan | 72/229 |

*Primary Examiner*—Joseph J. Hail, III
*Assistant Examiner*—Rodney Butler
*Attorney, Agent, or Firm*—Anderson, Kill & Olick, P.C.

[57] ABSTRACT

The invention relates to an installation for cold rolling strip-shaped rolling material, with a reversing stand disposed between two reel-up or unreeling coils or reels, and a second reversing stand in the rolling line of the first reversing stand, with both stands capable of being adjusted corresponding to consecutive passes for performing the rolling process.

4 Claims, 6 Drawing Sheets

REVERSING COMPACT INSTALLATION FOR COLD ROLLING STRIP-SHAPED ROLLING MATERIAL

RELATED APPLICATION

This application is a continuation of application Ser. No. 08/762,904, filed Dec. 10, 1996, now U.S. Pat. No. 5,746,081, which, in turn, is a continuation—in part—of application Ser. No. 08/217,579 filed Mar. 25, 1994, now abandoned.

FIELD OF THE INVENTION

The invention deals with an installation for cold rolling of strip-shaped rolling material.

BACKGROUND OF THE INVENTION

The use of single stand reversing mills for cold rolling strip-shaped rolling material is well known. In such single stand reversing mills, up to approximately 450,000 tons per year of hot rolled strip can be cold rolled. If the steel plant has a higher output of hot rolled strips, then any hot rolled strips exceeding the approximately 450,000 tons per year yield could not be cold rolled and a second single stand reversing mill or train must be erected.

Another possibility is to provide a multi-stand, for instance, a four or five-stand tandem train, which works economically starting with an output of 1 million tons per year. In so-called "mini-steel plants," which have an output of approximately 700,000 tons per year, the use of a four-stand tandem train for cold rolling strips is not worthwhile for economic reasons. The single-stand reversing mill or train for cold rolling strips however is inadequate for rolling the entire output of a "mini-steel mill" into cold rolled strips. The solution of providing two single-stand reversing trains in one single "mini-steel plant" is also cost intensive because the two trains are not operating at full load capacity and since relatively high installation invention must be undertaken for the two trains.

Another disadvantage of a single reversing stand, compared to multi-stand installations, is the inability to use a roughened in the last pass.

It is therefore an object of the invention to provide a cold rolling mill for a widely distributed assortment of strip-shaped rolling material.

Another object of the invention is to provide a reversing compact installation for cold rolling strip-shaped rolling material which has a yearly capacity of approximately 700,000 tons of cold rolled strip and which is thus optimally suited for use in "mini steel plants"—i.e. in production range between a reversing stand and a tandem train.

Yet another object of the invention is to assure that work rolls with variable diameters can be used to assure optimum pass reductions.

A further object of the invention is to permit use of roughened work rolls for the last pass.

Additionally, an object of the invention is to simplify and speed up the change of work rolls in case of friction driven work rolls, which again favors a higher throughout.

SUMMARY OF THE INVENTION

These and other objects of the invention, which shall be hereafter apparent, are achieved by a REVERSING COMPACT INSTALLATION FOR COLD ROLLING STRIP-SHAPED ROLLING MATERIAL with a reversing stand disposed between two reversible reels and a reel from which the strip to be used can be taken off.

Usually hot rolled strips were cold rolled in several passes. In a multi-stand tandem train, these passes are rolled in the course of one single passage, while in a single stand reversing train, three to seven passages must be performed.

Only two to three passages are however necessary in the two stand reversing train of the invention, so that a large throughput is achieved in the same time period compared to the single stand reversing trains. The installation proposed here is considerably more cost effective than two single-stand reversing trains. Also, the area requirement for the proposed two stand reversing train is smaller than in the case of two single stand reversing trains disposed, for instance, parallel to one another. It must be added that the two-stand reversing train can be arranged to lie in line with the strip treatment stations disposed upstream of the rolling train, whereas the two single stand reversing trains required for an output of approximately 700,000 tons must always be fed coils of hot rolled strips, through switches and displacement devices. It is also essential that, compared to the single-stand reversing train, a considerably higher strip tension level be achieved so that the reducing characteristic of a four to six-stand tandem train can be achieved.

BRIEF DESCRIPTION OF THE DRAWINGS

The invention will be better understood, by the Detailed Description of the Preferred Embodiment, in connection with the drawings of which.

DETAILED DESCRIPTION OF THE PREFERRED EMBODIMENT

Figure 1:
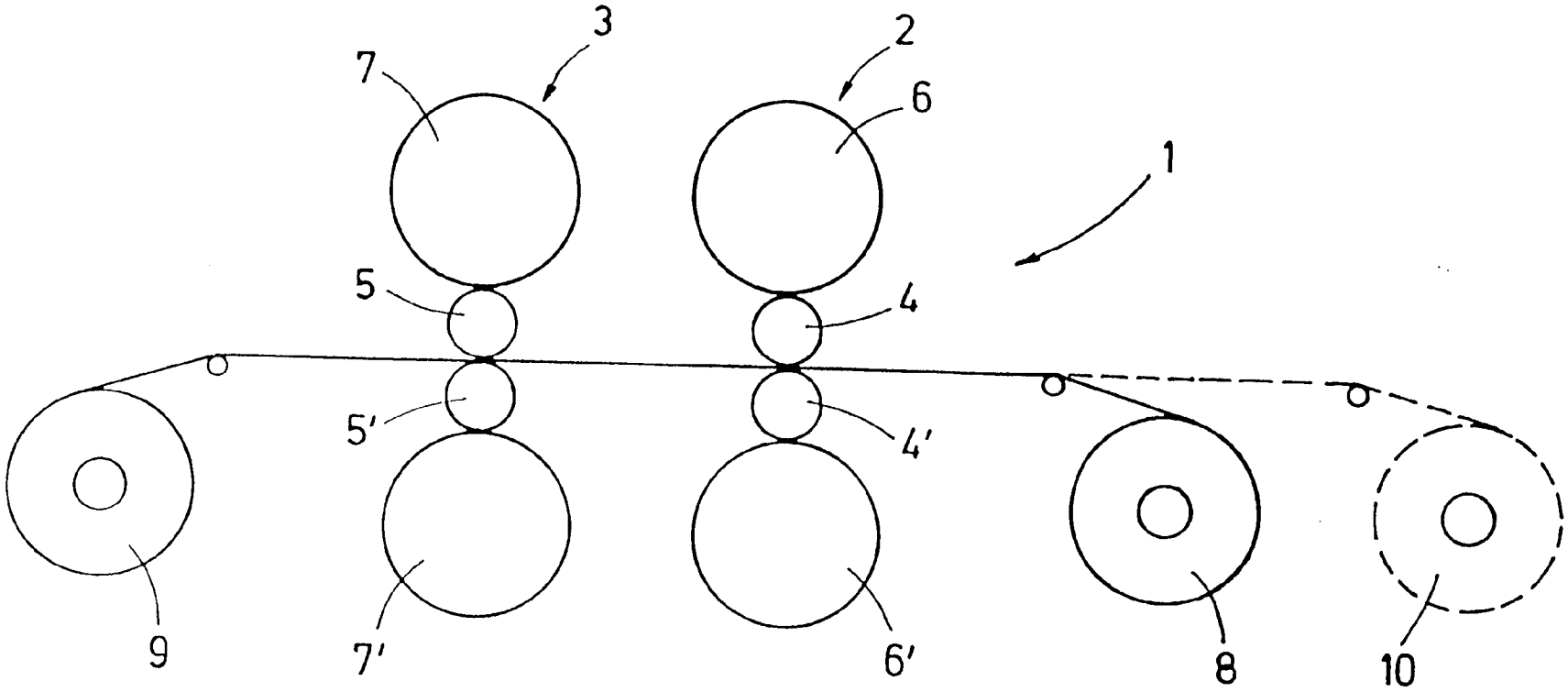
FIG. 1 shows a schematic of a two-stand reversing train of the invention.
Figure 1A:
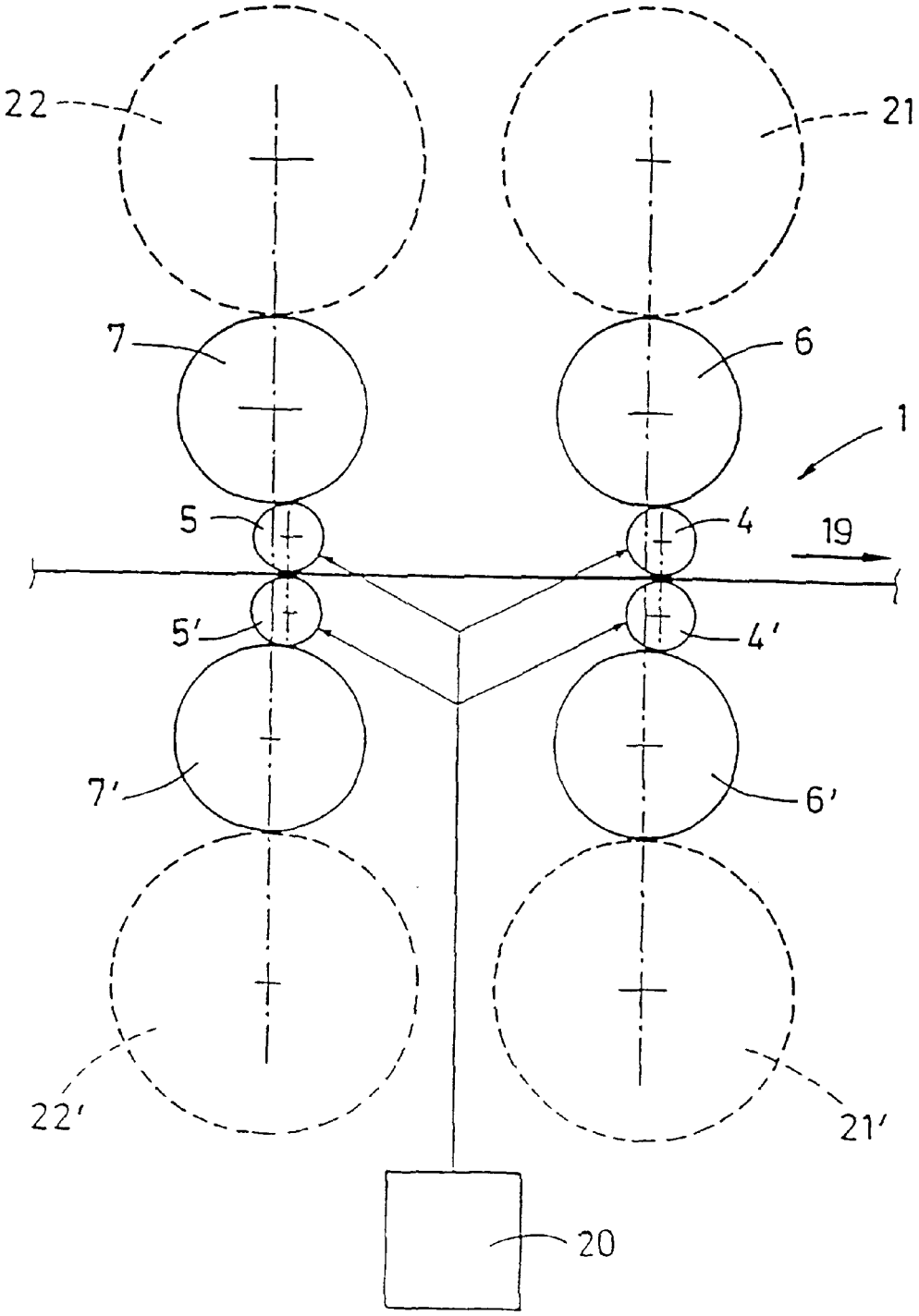
FIGS. 1*a* and 1*b* show partial schematic views of FIG. 1, where the working rolls have been moved out of the backup rolls place, in the strip travelling direction.
Figure 1B:
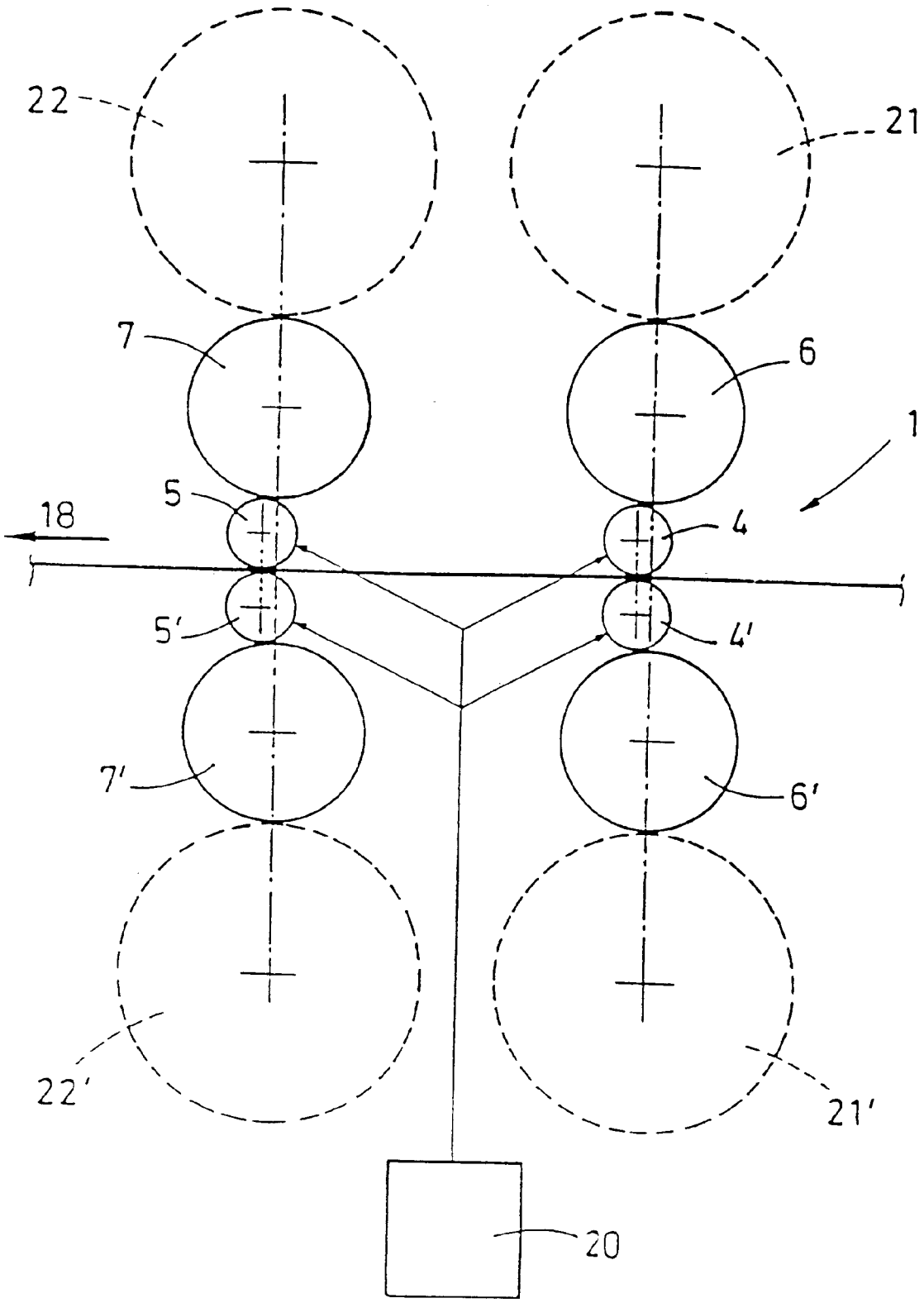

Referring now to the drawings, wherein like numerals reflect like elements, throughout the several views, FIG. 1 shows a cold rolling train 1 comprising two reversing stands 2, 3—in this case with four-high stands having work rolls 4, 4'; 5, 5' and backup rolls 6, 6'; 7, 7'. The two reversing stands 2, 3 are disposed between two reels 8, 9, which can provide the necessary tension for the reeling or unreeling in reversing operation.

A reel 10 serves for the taking-off hot rolled strip for the first pass and possibly for coiling the hot rolled strip of an upstream located processing line. The reel 10 can operate with a lower tensile force, compared to the reels 8, 9. The strip, which has to be taken-off the reel 10 during the reversing process in the course of which reels 8 and 9 are used, can be prepared to such an extent that following one rolling process, the next strip can be rolled without any large delay.

FIGS. 1(*a*) and 1(*b*) show a partial schematic view of FIG. 1, where the working rolls have been moved out of the backup rolls plane, in the strip travelling direction. The working rolls 4,4' and 5,5' are disposed to be offset relative to the vertical plan formed by the backup rolls 6,6', 7.7'. The arrows 18, 19 show the respective travel direction of the strip. The working rolls are horizontally displaced counter to the respective direction of the strip.

During the reversing process, the displacement device 20 causes an appropriate displacement of the working rolls, counter to the respective travel direction of the strip of the following pass. It is outlined in broken dotted lines in these Figures that the reversing stands can also be six high rolling stands. In that case, the rolls 6, 6', 7, 7' are used as intermediate rolls, while rolls 21, 21', 22, 22' constitute backups rolls. The displacement device can (in case of utilizing a six high rolling stand) if need be, also horizontally displace the intermediate rolls instead of the work rolls. Herein, the displacement of the intermediate rolls must however be counter to the horizontal travel direction of the strip in the following rolling pass.

Figure 2:
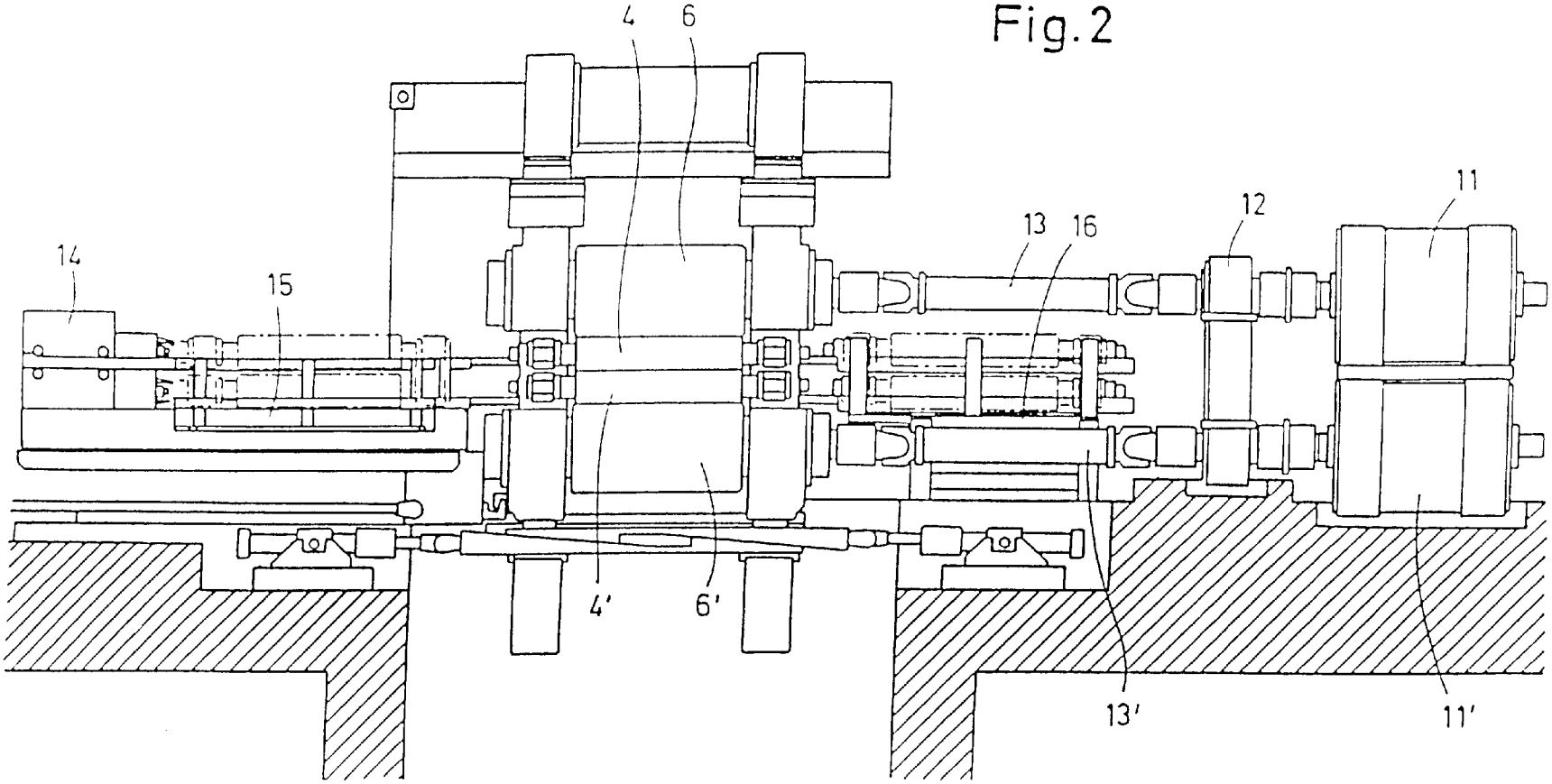
FIG. 2 shows a cross-sectional through the two stand reversing reain in the invention.

FIG. 2 depicts friction driven rolls in the work rolls 4, 4' (5, 5'). Drives 11, 11' operate through a gear box 12 and spindles 13, 13' upon the backup rolls 6, 6' (7, 7'). A roll changing device 14 pushes, in the course of work roll changes, the new prepared set of work rolls from the changing table 15 into the stand. The work rolls present in the stand are pushed herein upon the depositing or storage table 16. This enables a rapid change of work rolls. For instance, three to five passes can be performed with one set of work rolls and the respectively last pass (for instance pass 4 or pass 6) can be performed after the work rolls have been replaced by a set of work rolls having a different roughness.

Figure 2A:
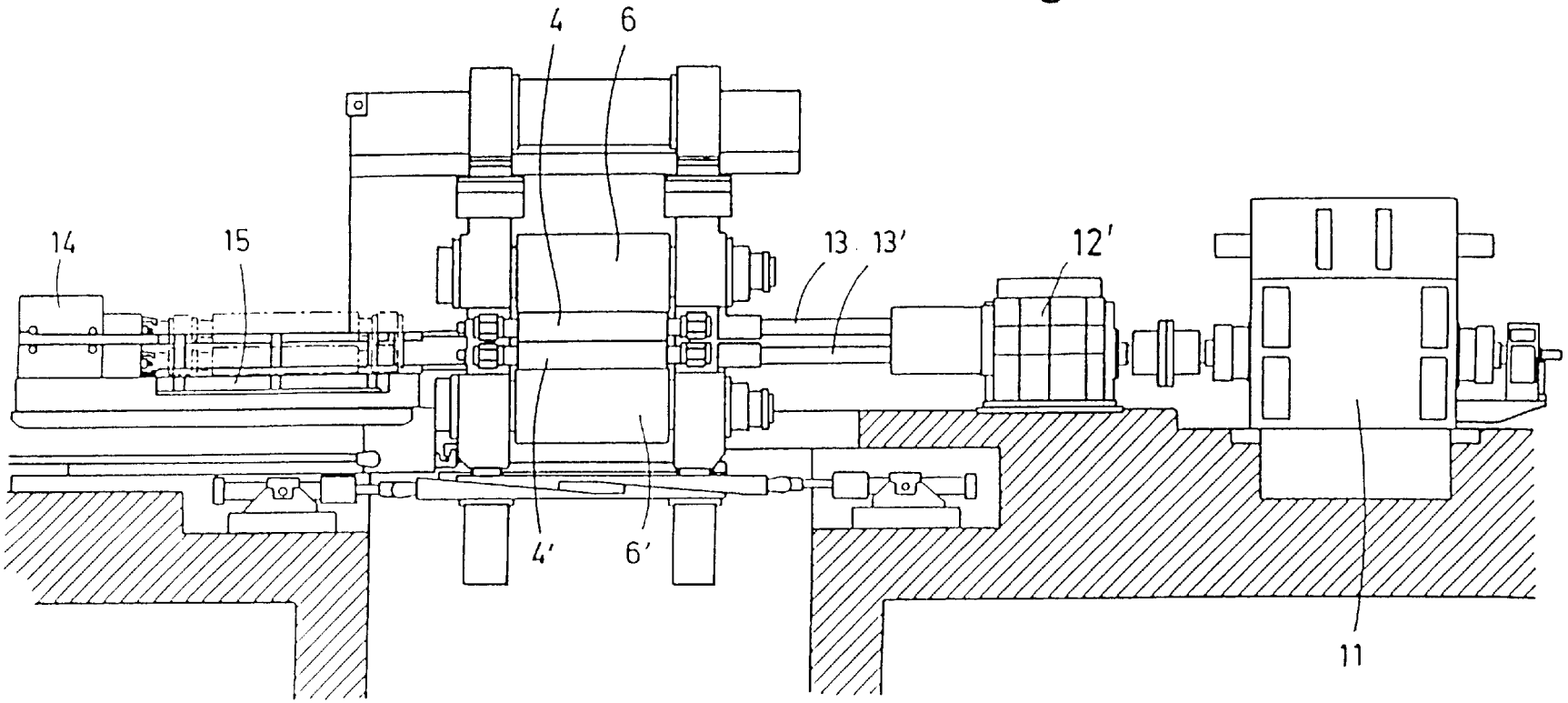
FIG. 2*a* shows a cross-sectional view through the two-stand reversing train according to another embodiment of the invention.

FIG. 2*a* shows a cold roll stand of another embodiment of a reversing cold roll train according to the present invention, in which the work rolls 4 and 4' are driven directly from the drive 11" through the gear box 12' and spindles 13 and 13'. With such directly driven work rolls, no horizontal stabilization is necessary, independent of the wear of rolls 4,4'.

The rapid work roll exchange, which was described above with reference to FIG. 2 is not any more possible, because the drive spindles 13" and 13"' located on the drive side prevent the positioning of a new work roll set. To this end, there is provided on the service side of the rolls and a changing device 14' and a changing table 15'. During the work rolls exchange, the changing device 14 pulls the used work roll set out of the stand and places it on the changing table 15'. Then, the changing table 15' is operated to place a new work roll set in front of the stand, and the changing device 14' pushes the new work roll set into the stand.

The quick work roll exchange is used, as it has already been mentioned above, for replacing a used set with a new one having different roughness. Advantageously such work roll exchange is provided for the final pass, in order to obtain a desired roughness of the strip surface. Of course, the work roll exchange can be effected not only for the final pass. The rapid work roll exchange can also be used for intermediate passes which require the use of working rolls having different diameters.

Figure 3A:
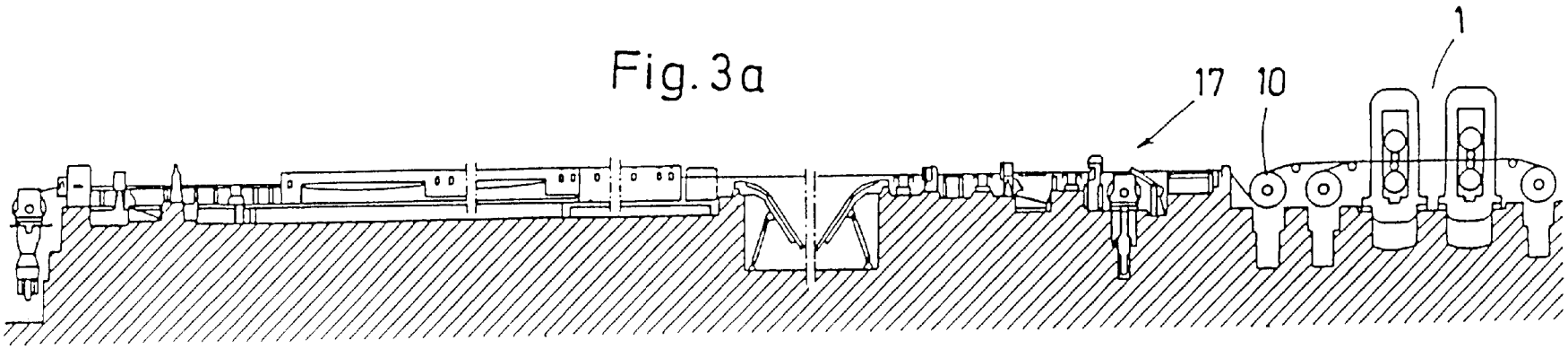
FIGS. 3*a* and 3*b* show a two-stand reversing train connected to a push type pickling installation.
Figure 3B:
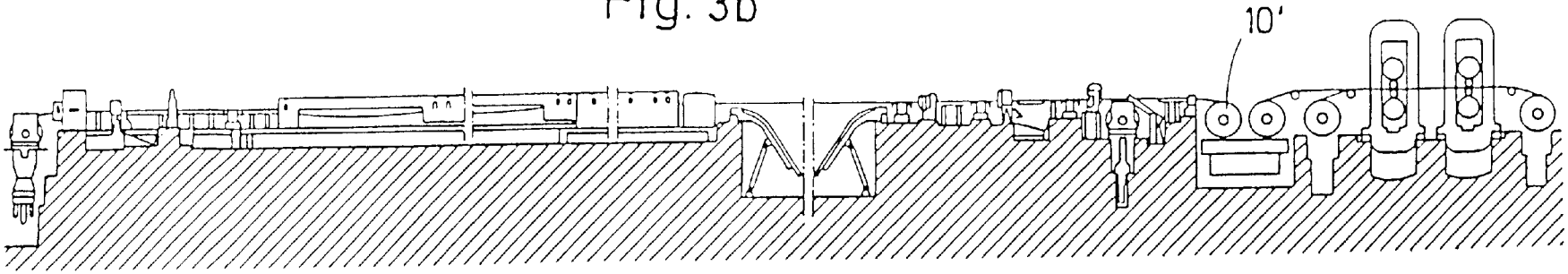

FIGS. 3*a* and 3*b* show the two-stand reversing train downstream of a push type pickling installation 17. The reel 10 can be seen in FIG. 3*a*, which reels up the strip emerging from the pickling installation 17, while the previous strip is rolled in the cold rolling train 1 in a reversing manner. Following thereupon, the reel 10 serves for unreeling the strip into the cold rolling train.

FIG. 3*b* shows that the reel 10' is a tension/pay-off reel which permits a simultaneous reeling and unreeling of the strip emerging from the push type pickling installation and also permits directing of the same towards the cold rolling train 1.

While the preferred embodiment of the invention has been depicted in detail, modifications and adaptations may be made thereto, without departing from the spirit and scope of the invention, as delineated in the following claims:

What is claimed is:

1. An installation for cold rolling a strip-shaped rolling material, comprising:

two reversing reels;

a first reversing stand disposed between the two reversing reels;

a reel from which the strip to be used can be taken off; and a second reversing stand provided in the rolling line of the first reversing stand, wherein both first and second reversing stands are adjustable in accordance with consecutive passes for performing the rolling process, wherein both first and second stands are simultaneously operated, wherein the reversing stands have each drive means for directly driving work rolls, wherein the reversing stands further comprise each linearly displaceable means arranged on a side of a respective reversing stand opposite to a side on which the drive means is arranged for a quick change of the work rolls with which the work rolls provided with work rolls blocks in the cassette type of construction can be changed in one of the through-push type of operation and a push-pull type of operation, whereby replacement of work rolls of different diameters and/or different roughness is possible.

2. The installation of claim 1, further comprising a push-type pickling installation disposed upstream of the reel-off reel.

3. The installation of claim 1, wherein the reel-off reel is a reversing reel.

4. A method of coldrolling of a strip-shaped rolling material, comprising the steps of:

providing a cold rolling installation including two reversing reels, a first reversing stand disposed between the two reversing reels, a reel from which the strip to be used can be taken off, and a second reversing stand provided in the rolling line of the first reversing stand, the first and second stands being adjustable in accordance with performed consecutive passes, operating simultaneously, and having each drive means for directly driving work rolls;

unwinding the strip-shaped rolling material from one of the two reversing reels, rolling the unwound strip-shaped rolling material in the first stand and then second stand, and winding rolled strip-shaped material onto another of the two reversing reels;

reversing the first and second stands;

unwinding the strip-shaped rolling material from another of the two reversing reels, rolling the strip-shaped rolling material in the second stand and then in the first stand, and winding the rolled strip-shaped rolling material onto the one of the reversing reels;

repeating the reversing process at least one more time; and changing, if necessary, in a last reversing process, the work rolls of one of the first and second stands, which is located downstream of another of the first and second stands in a rolling direction, by another work rolls having different roughness.

* * * * *